US005888255A

United States Patent [19]

Poirier

[11] Patent Number: 5,888,255

[45] **Date of Patent: *Mar. 30, 1999**

[54] DISTILLATE FUEL COMPOSITION OF REDUCED NICKEL CORROSIVITY

[75] Inventor: Marc-Andre Poirier, Sarnia, Canada

[73] Assignee: Exxon Research and Engineering Co., Florham Park, N.J.

[ * ] Notice: The term of this patent shall not extend beyond the expiration date of Pat. No. 5,653,787.

[21] Appl. No.: 947,534

[22] Filed: Oct. 10, 1997

[51] Int. Cl.[6] ..... C10L 1/22; C10L 1/24

[52] U.S. Cl. ..... 44/341

[58] Field of Search ..... 44/432, 343, 341

[56] References Cited

U.S. PATENT DOCUMENTS

| | | | |
|---|---|---|---|
| 3,663,561 | 5/1972 | Blaha | 548/142 |
| 4,464,276 | 8/1984 | Sung et al. | 508/279 |
| 4,871,465 | 10/1989 | Hutchison | 508/273 |
| 5,035,720 | 7/1991 | Weers | 44/343 |
| 5,141,675 | 8/1992 | Vanderpool et al. | 252/389.23 |
| 5,143,634 | 9/1992 | Quinga et al. | 508/281 |
| 5,653,787 | 8/1997 | Poirier | 44/341 |

*Primary Examiner*—Margaret Medley
*Attorney, Agent, or Firm*—Joseph J. Allocca

[57] ABSTRACT

A distillate fuel composition for reducing nickel corrosion in internal combustion engine by contaminants in the motor fuel such as sulfuric acid, alkyl sulfate esters, comprising a motor fuel and a combination of at least one 2,5 dihydrocarbyldithio-1,3,4 thiadiazole of the formula wherein $R_1$ and $R_2$ are independently H or $R_3S$, where $R_3$ is a hydrocarbyl group containing from 1 to 16 carbon atoms with the proviso that at least one of $R_1$ and $R_2$ is not hydrogen, and an adduct of benzotriazole or tolyltriazole and an amine.

14 Claims, 10 Drawing Sheets

DISTILLATE FUEL COMPOSITION OF REDUCED NICKEL CORROSIVITY

BACKGROUND OF THE INVENTION

1. Field of the Invention

The invention relates to distillate fuel compositions of reduced nickel corrosivity containing additives.

2. Description of the Related Art

Acidic sulfur species such as sulfonic acids, alkyl sulfate esters and sulfuric acid contained in hydrocarbon streams are corrosive and damaging to metal equipment, particularly nickel and nickel alloys such as Monel (70% Ni/30% Cu). Acidic sulfur compounds may be present in varying concentrations in refined fuel products that comprise in whole or in part alkylate product. Alkylate product may sometimes contain small amount of corrosive sulfur compounds. The compounds are usually alkyl sulfate esters formed by the addition of sulfuric acid to the olefin in the alkylation process. These resulting esters can hydrolyzed in the presence of heat and water to sulfuric acid and alcohol. Formation of these alkyl esters is inherent in the alkylation mechanism; however, under proper operating conditions the reaction is of only minor importance. The sulfuric acid resulting from the decomposition of even these minor concentrations of esters has a particularly corrosive effect on equipment such as nickel director in engine injection system, nickel parts in in-tank fuel pump in motor vehicles, etc.

Corrosion of silver, copper and copper alloy by elemental sulfur in fuels is controlled by use of additives. These additives are either sulfur scavengers or metal deactivators that coat metal surfaces thus preventing attack of the surface by sulfur or sulfur species.

Up to now, however, no commercial corrosion inhibitors were known that were suitable for preventing corrosion of nickel from acidic sulfurous species such as sulfuric acid, sulfurous acid or alkyl sulfate esters. Nickel parts are common in internal combustion engines and in the fuel systems for such engines.

U.S. Pat. No. 3,663,561 discloses useful 5-mercapto-2-hydrocarbyldithio-1,3,4-thiadiazoles and their preparation thereof. This type of compound is well known to have the ability to inhibit corrosion of copper, brass and silver metal parts from elemental sulfur. The commercially available Elco 461, a 2,5-(bis)-(hydrocarbyldithio-1,3,4-thiadiazole, Hitec 4313, Hitec 4312 and Tolad 9717 fall in this category.

U.S. Pat. No. 5,035,720 discloses oil soluble adducts of a triazole and a basic nitrogen compound (an amine) which are useful for inhibiting corrosion of copper and aluminum surfaces in fuel systems, and more particularly to such compositions and methods for inhibiting corrosion of copper and aluminum surfaces in petroleum-based fuel systems which contain elemental sulfur or sulfur-containing compounds, such as mercaptans. The triazole is benzotriazole or tolyltriazole. The amine is water-insoluble such as alkoxyamine with 2–15 alkoxy groups. The adduct is obtaining from tolyltriazole and bis (hydroxyethyl) cocoamine, bis (hydroxyethyl) octadecylamine, bis (hydroxyethyl)-2-ethylhexyl-amine or bis (hydroxyethyl) oleylamine.

U.S. Pat. No. 5,653,787 relates to an additive composition for reducing silver corrosion in two-cycle engines running on gasoline containing elemental sulfur contaminant, the additive comprising a 2,5-dihydrocarbyldithio- 1,3,4-thiadiazole in combination with an adduct of benzotriazole or tolyltriazole with an alkoxyamine.

U.S. Pat. No. 4,871,465 discloses lubricating oils that contain a silver protective agent comprising: (a) a sulfurized olefin, sulfurized fatty acid, sulfurized hydroxyaromatic compound, sulfur heterocyclic compound, organic sulphide or dithiocarbamate, or (b) a product obtained by reacting a saturated aliphatic hydrocarbon-substituted dicarboxylic acid with a 1–15 carbon hydrocarbyl substituted aminoguanidine. The combination of (a) and (b) have a synergistic affect in reducing wear of silver bearings and avoid the environmental problems associated with chlorinated hydrocarbons. The oils are especially suitable for use in medium-speed diesel engines such as are used in railway locomotives, marine tugs and stationary power units.

U.S. Pat. No. 5,141,675 discloses a method for inhibiting the corrosion of metallic surfaces, particularly copper/nickel alloy surfaces in contact with aqueous system, comprising adding to the aqueous system being treated an effective amount of a polyphosphate in combination with an alkyl or alkoxy benzotriazole, tolytriazole or mercaptobenzothiazole derivative.

U.S. Pat. No. 4,464,276 discloses the combination of (di) amine adducts of benzotriazoles with overbased sulfurized calcium alkylphenolate. The additives mixture is useful as antioxidant and corrosion inhibitor in medium speed diesel lubricant compositions. There is no mention of the use of 2,5-hydrocarbyldithio-1,3,4-thiadiazole.

U.S. Pat. No. 5,143,634 discloses a lube composition encompassing (i) Mannich reaction product of benzotriazole, amine and formaldehyde, (ii) sulfur-containing compound, and (iii) metallic detergent.

DESCRIPTION OF THE FIGURES

FIG. 1(*b*) is an EDS spectrum of the surface of a nickel disk immersed in gasoline containing 6 vppm $H_2SO_4$ and 1000 vppm methanol showing S and O peaks indicative of nickel sulfate corrosion products.

FIG. 2(*b*) is an EDS spectrum of the surface of a nickel disk immersed in gasoline containing 8 vppm $H_2SO_4$. 50 vppm HITEC 4313, 200 vppm Tolad 9702 and 1000 vppm methanol showing no sulfur, indicating that methanol did not degrade the anti corrosion performance of the additive combination.

FIG. 4(*b*) is an EDS spectrum of the back surface of a nickel disk immersed in gasoline containing 8 vppm $H_2SO_4$ and 400 vppm of an additive containing a corrosion inhibitor showing S and O peaks indicative of the presence of nickel sulfate corrosion product.

FIG. 6(*b*) is an EDS spectrum of the surface of a nickel disk immersed in gasoline containing 8 vppm $H_2SO_4$ and 50 vppm HITEC 4313 showing O and S peaks indicative of the presence of nickel sulfate corrosion product.

SUMMARY OF THE INVENTION

Figure 1:
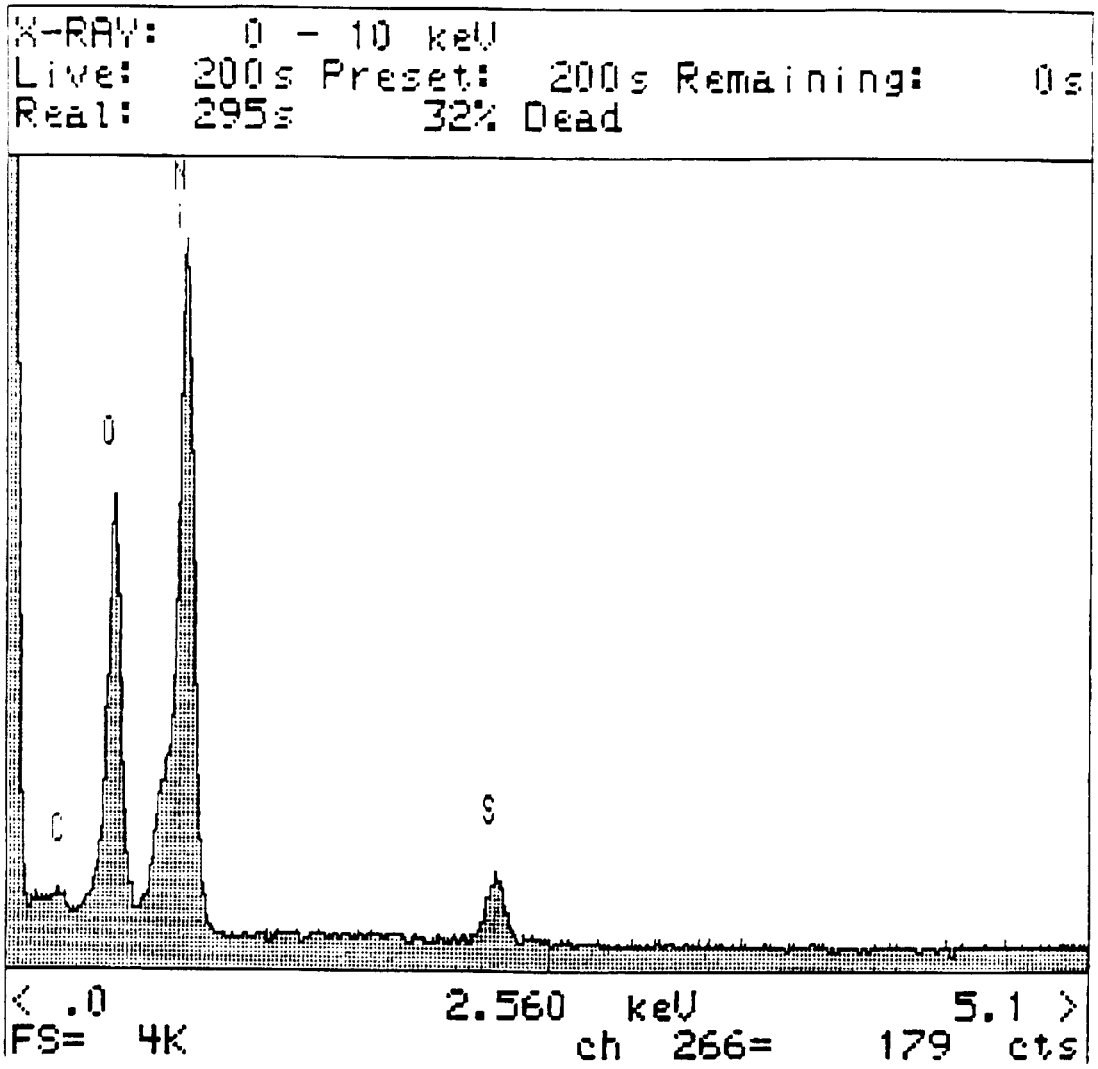
FIG. 1(*a*) is a qualitative Energy Dispersive X-Ray Spectroscopy (EDS) spectrum of the surface of a nickel disk immersed in gasoline containing 8 vppm $H_2SO_4$ and no anticorrosion additives showing S and O peaks indicative of nickel sulfate corrosion product.
Figure 1:
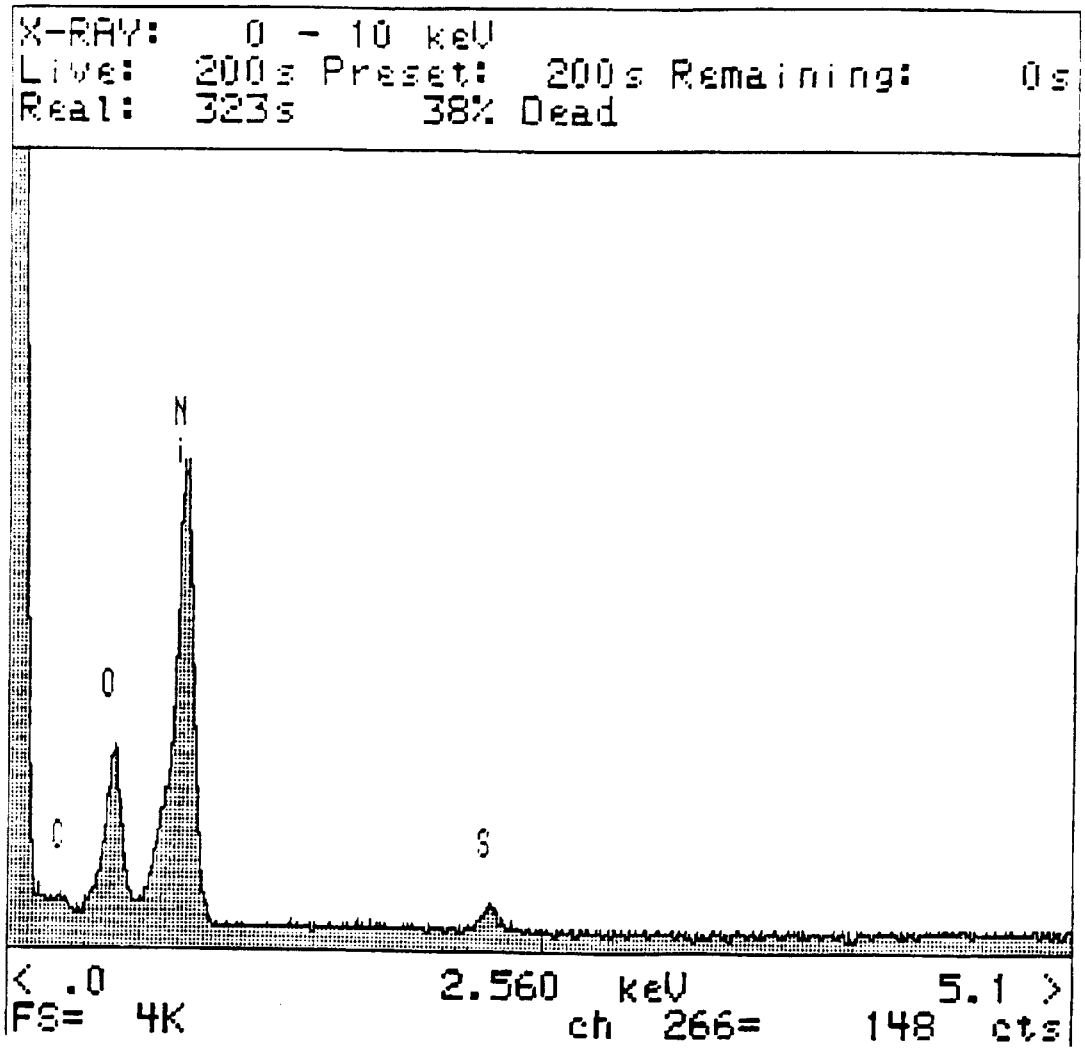

The present invention relates to distillate fuel having improved resistance to nickel corrosion containing acidic sulfur species contamination comprising sulfuric acid, alkyl sulfate esters, and sulfonic acid and a synergistic combination of (a) at least one 2,5-dihydrocarbyl dithio-1,3,4-thiadiazole of the formula

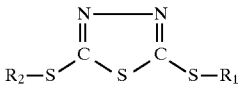

wherein $R_1$ and $R_2$ are hydrogen or $R_3S$ wherein $R_3$ is a $C_1$ to $C_{16}$, preferably a $C_1$–$C_{12}$ hydrocarbyl group with the proviso that at least one of $R_1$ and $R_2$ is not hydrogen and (b) at least one adduct of benzotriazole or tolyltriazole and an amine, preferably a fatty amine, most preferably an alkoxy fatty amine.

The distillate fuels can contain from 0.5 vppm to 20 vppm, more typically 0.5 to 10 vppm of acidic sulfur compounds constituting sulfuric acid, sulfurous acid and hydrocarbyl sulfate esters, more typically alkyl sulfate esters. Such species are present in the fuel, usually as a result of the addition of alkylate to the fuel base stock.

Distillate fuels are those falling in the gasoline and diesel and light heating oil boiling ranges, preferably, the gasoline and diesel fuel boiling ranges.

The invention also relates to a method for reducing nickel corrosion in internal combustion engines or oil burners, preferably internal combustion engines operated on fuels containing acidic sulfur compound contamination comprising sulfuric acid, sulfurous acid and hydrocarbyl sulfate esters by adding to the fuel a synergistic mixture comprising at least 2,5-dihydrocarbyl dithiadiazole and at least one adduct of benzotriazole or tolyltriazole with amine, preferably alkoxyamine, described above.

DETAILED DESCRIPTION OF THE INVENTION

The present invention is directed to a distillate fuel for the operation of internal combustion engines or fuel burners, preferably internal composition engines containing nickel or nickel alloy parts, said distillate fuel containing acidic sulfur compounds comprising sulfuric acid, sulfurous acid and hydrocarbyl sulfate esters and a minor, synergistic amount of an additive comprising (a) at least one 2,5 hydrocarbyl dithio 1,3,4 thiadiazole and (b) at least one adduct of benzotriazole or tolyltriazole and amine, preferably fatty amine, most preferably alkoxy fatty amines. Use of such fuel containing such additives in internal combustion engines containing nickel parts is marked by a reduction in the degree of corrosion experienced by the nickel parts in the engine. The distillate fuels of the present invention are those having a boiling range from about 4° C. to 350° C. and include gasoline boiling in the motor range of from about 4° C. to 225° C., e.g., gasoline as defined by ASTMD-439-73, and diesel fuel, and kerosene boiling in the range of from about 175° C. to 350° C., and containing acidic sulfur contaminants comprising sulfuric acid, sulfurous acid and hydrocarbyl sulfate esters. Such contaminants are present in the fuel as a consequence of the fuel constituting in whole or in part an alkylate component.

In the additive combination noted above, component (a) is a thiadiazole of the formula:

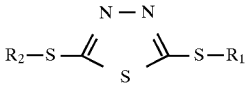

where $R_1$ and $R_2$ are hydrogen or $R_3S$, $R_3$ is preferably a $C_1$ to $C_{16}$ preferably $C_1$ to $C_{12}$ hydrocarbyl group. The hydrocarbyl groups include aliphatic (alkyl or alkenyl) and alicyclic groups which may be substituted with hydroxy, amino, nitro and the like. Examples of preferred $R_3$ groups include methyl, ethyl, n- and iso-propyl, n-, sec- and tert-butyl, hexyl, cyclohexyl, octyl, decyl and dodecyl.

Preferred compound (b) are tolyltriazole adducts including the 1:1 adducts of tolyltriazole with fatty amines. Especially preferred fatty amines have the formula $R_4R_5NR_6$ where $R_4$ and $R_5$ are $C_1$ to $C_4$ hydrocarbyl groups preferably wherein at least one is substituted with hydroxy, particularly $C_2$ alkyl substituted with hydroxy, and $R_6$ is a $C_8$ to $C_{20}$ hydrocarbyl group, especially $C_{12}$ to $C_{18}$ alkyl or alkenyl. Examples of preferred adducts include the 1:1 adduct between tolyltriazole and bis(2-hydroxyethyl)oleylamine and between tolyltriazole and (2-hydroxyethyl) cocoamine.

The tolyltriazole or benzotriazole adducts with amines, fatty amines, alkoxyamines, aryloxyamines and mono alkenyleneamines may be prepared by the methods described in U.S. Pat. No. 5,035,720. These adducts are commercially available from Petrolite Corporation and are referred to Tolad 9701 and Tolad 9702. In general, the amine is heated to between 70° C. and 100° C. and tolyltriazole added slowly to the heated amine with stirring. Tolyltriazole is added to the amine in an approximate 1:1 mole ratio. Upon completion of the reaction, the reaction mixture is cooled and may be used without further purification.

The fuels of this invention typically contain from 0.5 vppm to 20 vppm more 0.5 vppm to 10 vppm of acidic sulfur contaminants comprising alkyl sulfate esters such as dibutyl sulfate, sulfuric acid and sulfurous acid. Such contamination by alkyl sulfate esters and/or sulfuric and/or sulfurous acid usually occurs as a consequence of blending an alkylate component into the fuel. Such alkylate component is usually the liquid fraction produced by the strong sulfuric acid-catalyzed alkylation Of $C_3$ to $C_5$ olefins with isobutane. Alkylate is a high octane blending stock component for gasoline. The chemistry of the alkylation reactions is well documented. The alkylation product known as "alkylate" sometimes contains small amounts of alkyl sulfate esters. These alkyl esters are formed by the addition of sulfuric acid to the olefin. These alkyl sulfate esters can decompose to sulfuric acid i n the presence of heat and water in the fuel injection system producing nickel sulfate crystals and causing drive-ability problems, associated with the corrosion of the nickel component.

The precise amount and ratio of thiadiazole and of the triazole adduct can vary broadly.

Typically, however, the amount of the at least one thiadiazole component will range from about 5 to about 50 vppm for every 1 vppm of acidic sulfur species contamination, e.g., alkyl sulfate ester or sulfuric acid, present in the fuel, al though greater amounts could be used. Preferably, from about 1 to about 10 vppm of the thiadiazole component be present in the fuel. The amount of the at least one benzotriazole and/or tolyltriazole adduct will generally range from about 50 to about 500 vppm for every vppm of acidic sulfur species contamination present in the fuel. Preferably from about 4 to about 40 vppm of tolyltriazole adduct be present in the fuel.

Other additives which may be present in the fuel, include alcohols, ethers such as MTBE, detergents or dispersants, antioxidants, demulsifiers and the like. Alcohols and glycols in amounts in the range of about 50 to 10,000 vppm can be used as nickel sulfate solubilizer, said nickel sulfate resulting from the corrosion of nickel with sulfuric acid. Alcohols and glycols are well known fuel anti-icing agent that can be used to prevent crystallization of the produced nickel sulfate on the nickel metal surface when temperature is below freezing point (0° C.). Examples of glycols that can be used include ethylene glycol, diethylene glycol, dipropylene glycol and the like.

The following examples illustrate the invention.

TEST PROCEDURE

SOAK TEST DESCRIPTION 200 mL of gasoline was spiked with 60 μL of a solution consisting of 20 to 267 μL concentrated sulfuric acid in 10 μL of distilled water giving a water concentration of 300 vppm and a sulfuric acid concentration in the range from 0.6 to 8 vppm. The spiked gasoline was then placed in an ultrasonic bath for 2 minutes to produce a water haze in the gasoline. To the gasoline was then added a nickel disk weighing about 160 to 170 mg having a diameter of about 1 cm and a clean magnetic bar. Optionally a corrosion inhibitor additive was also added to the gasoline prior to the addition of the acidic water solution. The solution was agitated magnetically for 16 hours at −1° C. in a refrigerator. After that period the whole surface of the nickel disk was examined by using a JEOL JSM-840A Scanning Electron Microscope (SEM) equipped with Link AN10000 Energy Dispersive X-Ray Microanalysis System (EDS) was used for qualitative x-ray microanalysis of the nickel plate surfaces.

Spectra were collected at two conditions: (i) x-ray range 0–10 keV; SEM Accelerating Voltage at 10 keV; EDS Detector set at Open Window; and (ii) x-ray range 0–20 keV; SEM Accelerating Voltage at 20 keV; EDS Detector set at Beryllium (Be) Window.

The labels printed on the EDS x-ray spectra are further described below:

X-Ray: Acquisition type displayed.

Range: Selected Range in keV displayed (e.g., 0–10 keV, 0–20 keV).

Live: The amount of time (seconds) the processor measures pulses. Displayed as elapsed livetime, present livetime and remaining livetime.

Real: Actual elapsed time (seconds) displayed.

% Dead: Display average value calculated from the displayed live and real times. The percent of time within an acquisition period that the processor is closed down (e.g., all pulses generated during this dead period are rejected).

Energy Units: Electron Volts.

Energy Range: Energy range (keV) of displayed spectrum. Values of lower (<) and upper (>) energy ranges are shown.

Full Scale: The vertical full scale (FS) is displayed in thousands of counts fir FIG. 1 (*a*) FS:4K means (e.g.,=4, 000 count).

Cursor Channel: The value of the cursor channel it location its energy (keV) and counts (cts) are shown (for example, for FIG. 1(*a*) Ch location is 266, energy is 2.56 keV counts are 179 cts).

Peaks: The peak about 0 keV is a triggered noise peak. Spectral peaks are identified and labeled by the Analyst.

EXAMPLE 1

Following test procedure described above, this Baseline Example shows that the presence of 8 vppm sulfuric acid (FIG. 1(*a*)) in the gasoline caused corrosion of the nickel disk. This is shown by the presence of sulfur and oxygen peak in the EDS spectrum, indicative of nickel sulfate corrosion product. The test was repeated (FIG. 1 (*b*)) with 6 vppm sulfuric acid in the gasoline and 1000 vppm methanol. Methanol did not prevent corrosion of the nickel disk.

EXAMPLE 2

Figure 2:
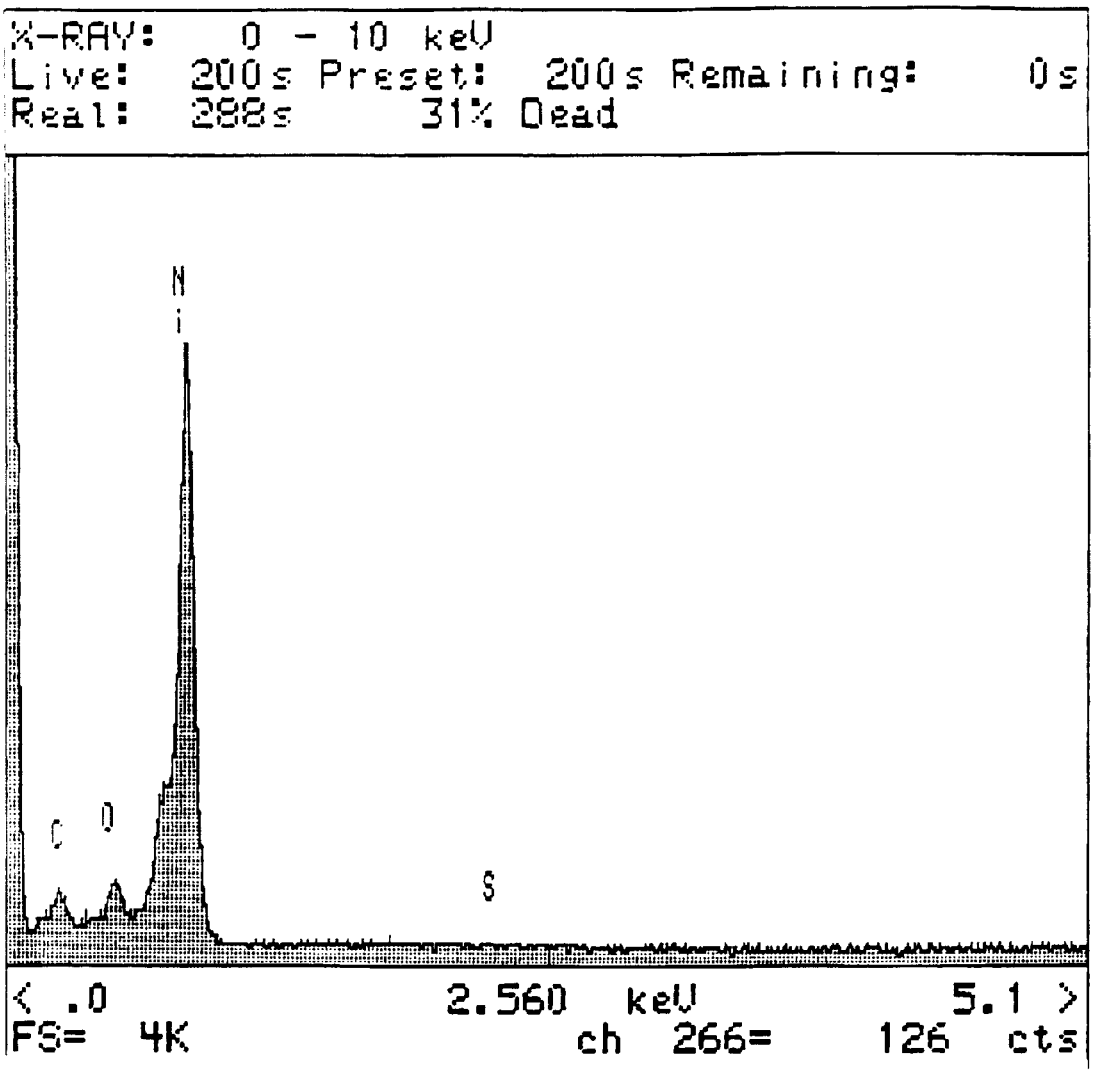
FIG. 2(*a*) is an EDS spectrum of the surface of a nickel disk immersed in gasoline containing 8 vppm $H_2SO_4$ and 50 vppm HITEC 4313 plus 200 vppm Tolad 9702 showing no sulfur peak, indicative of no nickel corrosion.
Figure 2:
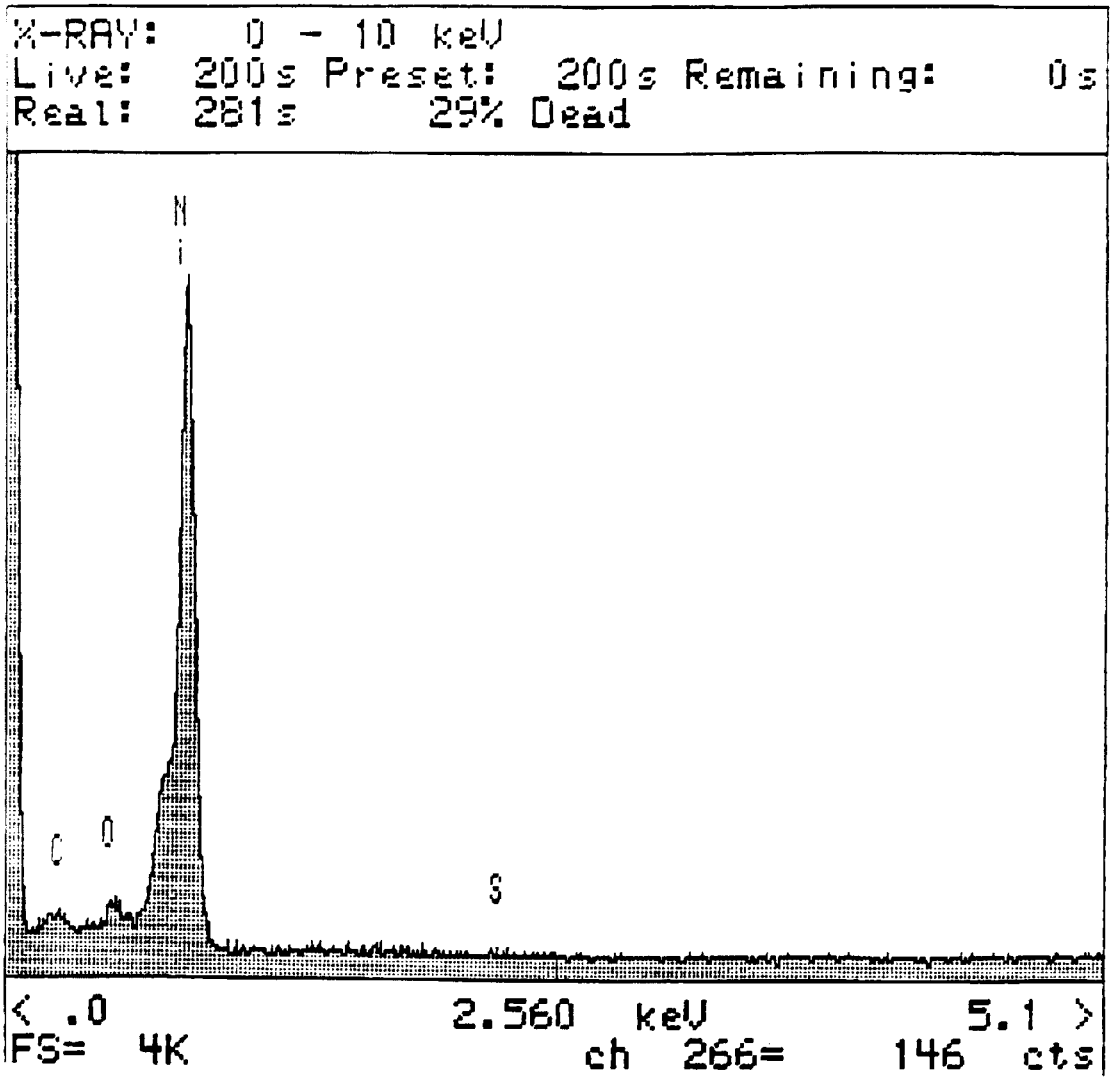

Following the test procedure described above, this Example shows that 50 vppm of thiadiazole additive Hitec 4313 plus 200 vppm Tolad 9702 prevented nickel corrosion in gasoline containing 8 vppm sulfuric acid. This is shown in FIG. 2 (*a*) by the absence of sulfur and oxygen peaks. The presence of 1000 vppm methanol did not degrade the additive performance FIG. 2 (*b*).

EXAMPLE 3

Figure 3:
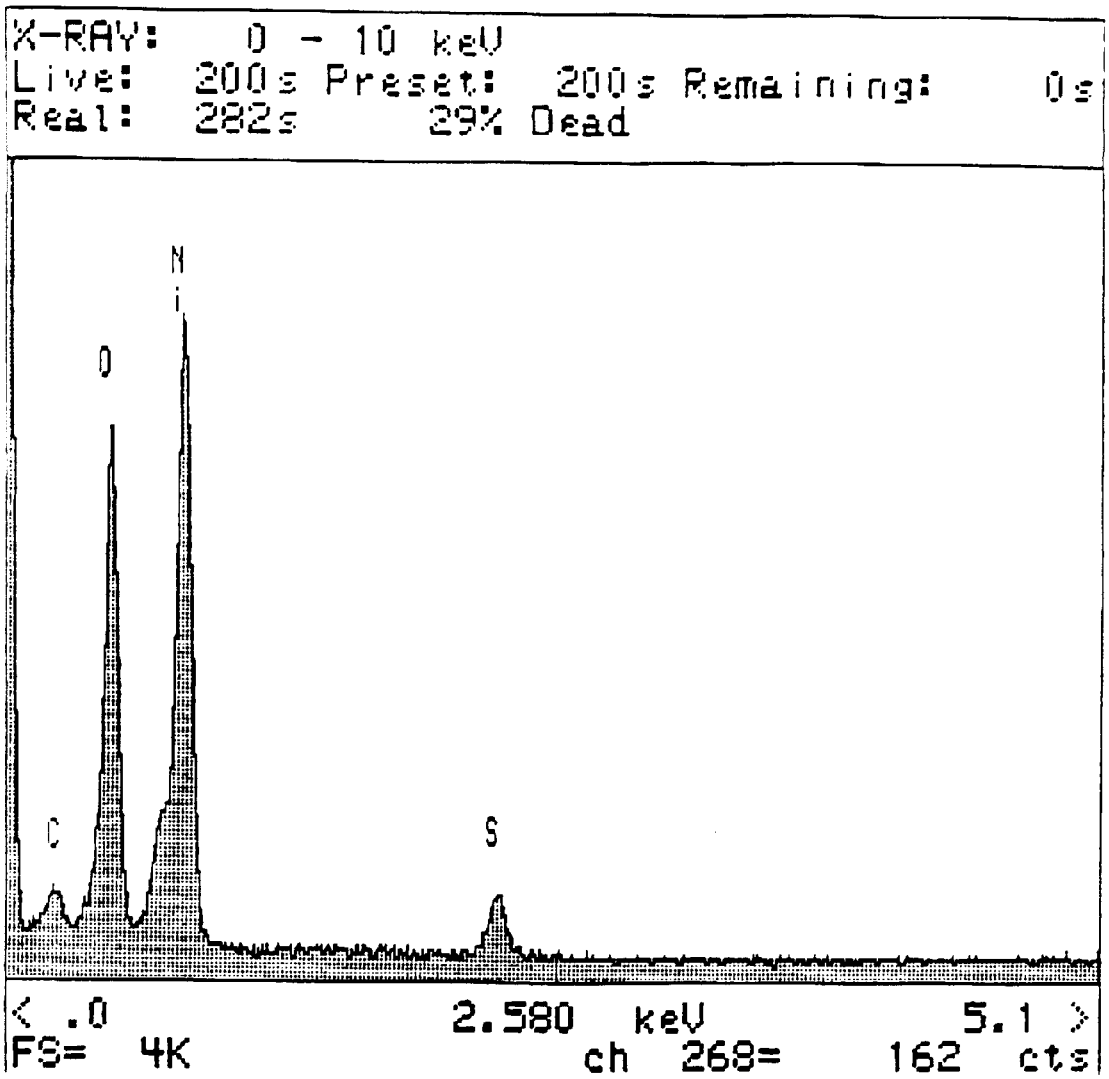
FIG. 3 is an EDS spectrum of the back surface of a nickel disk immersed in gasoline containing 8 vppm $H_2SO_4$ and 250 vppm Tolad 3306 corrosion inhibitor showing S and O peaks indicative of nickel sulfate corrosion product.

Following test procedure described above, this Example shows that 250 vppm of Tolad 3306 added to the gasoline containing 8 vppm sulfuric acid did not prevent the corrosion of the nickel disk (FIG. 3). Lots of nickel sulfate crystals were observed on the surface of the nickel disk.

EXAMPLE 4

Figure 4:
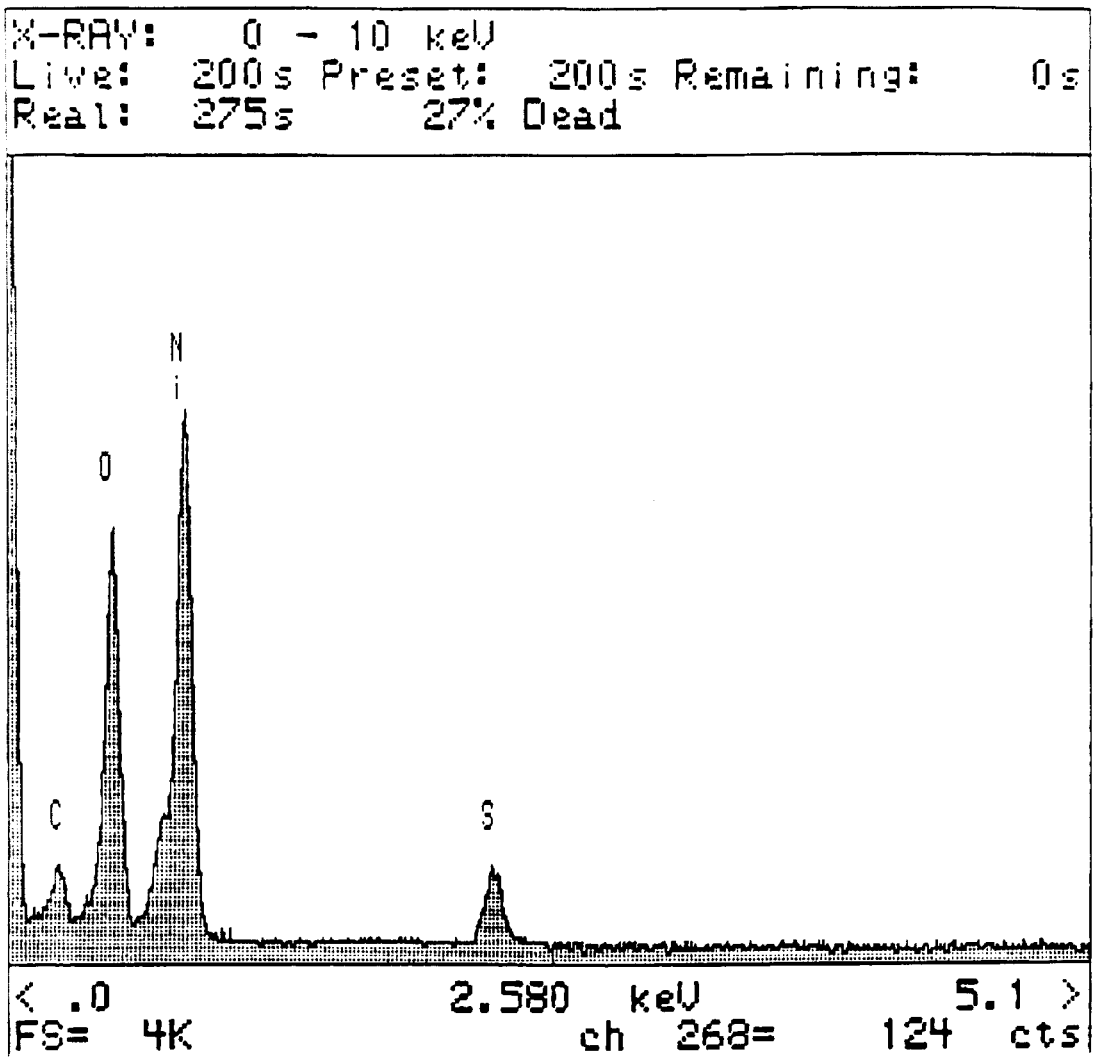
FIG. 4(*a*) is an EDS spectrum of the back surface of a nickel disk immersed in gasoline containing 8 vppm $H_2SO_4$ and 417 vppm of a commercial additive containing Tolad 3306 corrosion inhibitor and PIB amine detergent showing S and O peaks indicative of nickel sulfate corrosion product.
Figure 4:
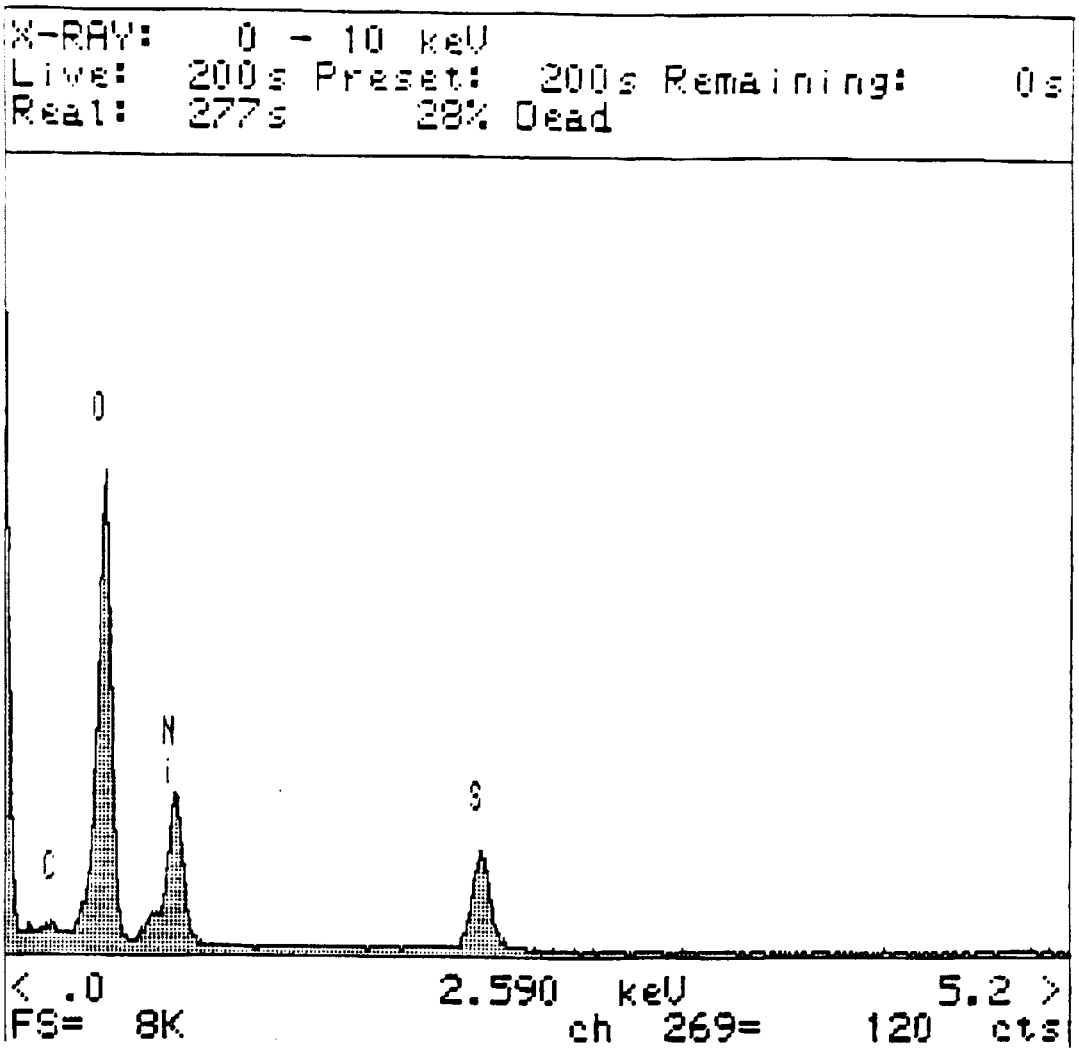

This Example shows that 417 vppm of a commercial gasoline additive containing a corrosion inhibitor (Tolad 3306) and a detergent (PIB amine) did not prevent nickel corrosion by 8 vppm sulfuric acid (FIG. 4 (*a*)). Similar results were obtained with 400 vppm of an additive package (z) containing an anticorrosion component (FIG. 4 (*b*)).

EXAMPLE 5

Figure 5:
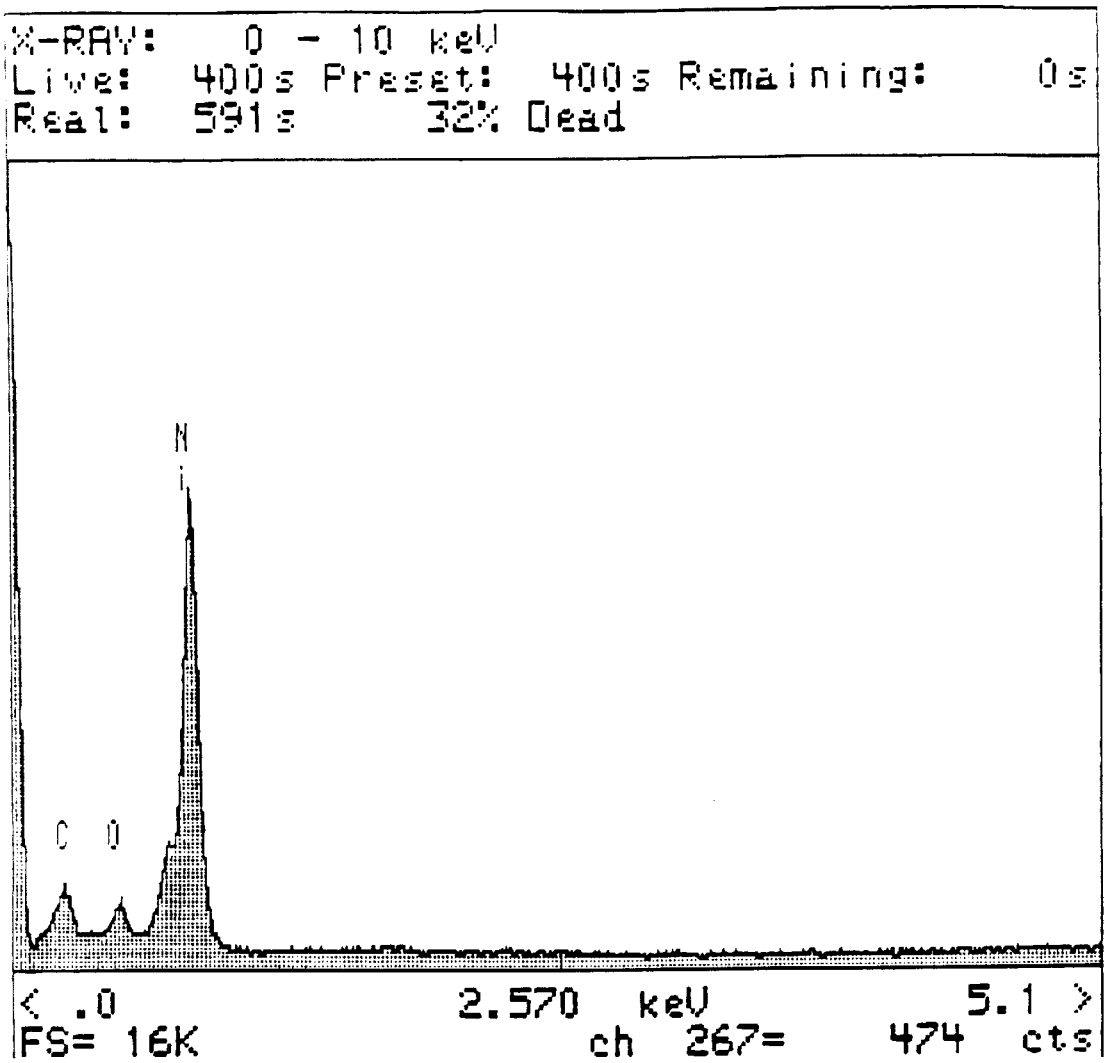
FIG. 5 is an EDS spectrum of the surface of a nickel disk immersed in gasoline containing 8 vppm $H_2SO_4$ and 50 vppm HITEC 4313 plus 200 vppm Tolad 9702 and 400 vppm of the additive of FIG. 4(*b*) showing the absence of O and S peaks, indicative of no nickel corrosion.

This Example shows that addition of 50 vppm Hitec 4313 plus 200 vppm Tolad 9702, as per this invention, to gasoline containing 8 vppm sulfuric acid and 400 vppm of the additive package of Example 4 (FIG. 5) provided nickel corrosion protection whereas the 400 vppm of additive package (z) alone did not (see FIG. 4 (*b*)).

EXAMPLE 6

Figure 6:
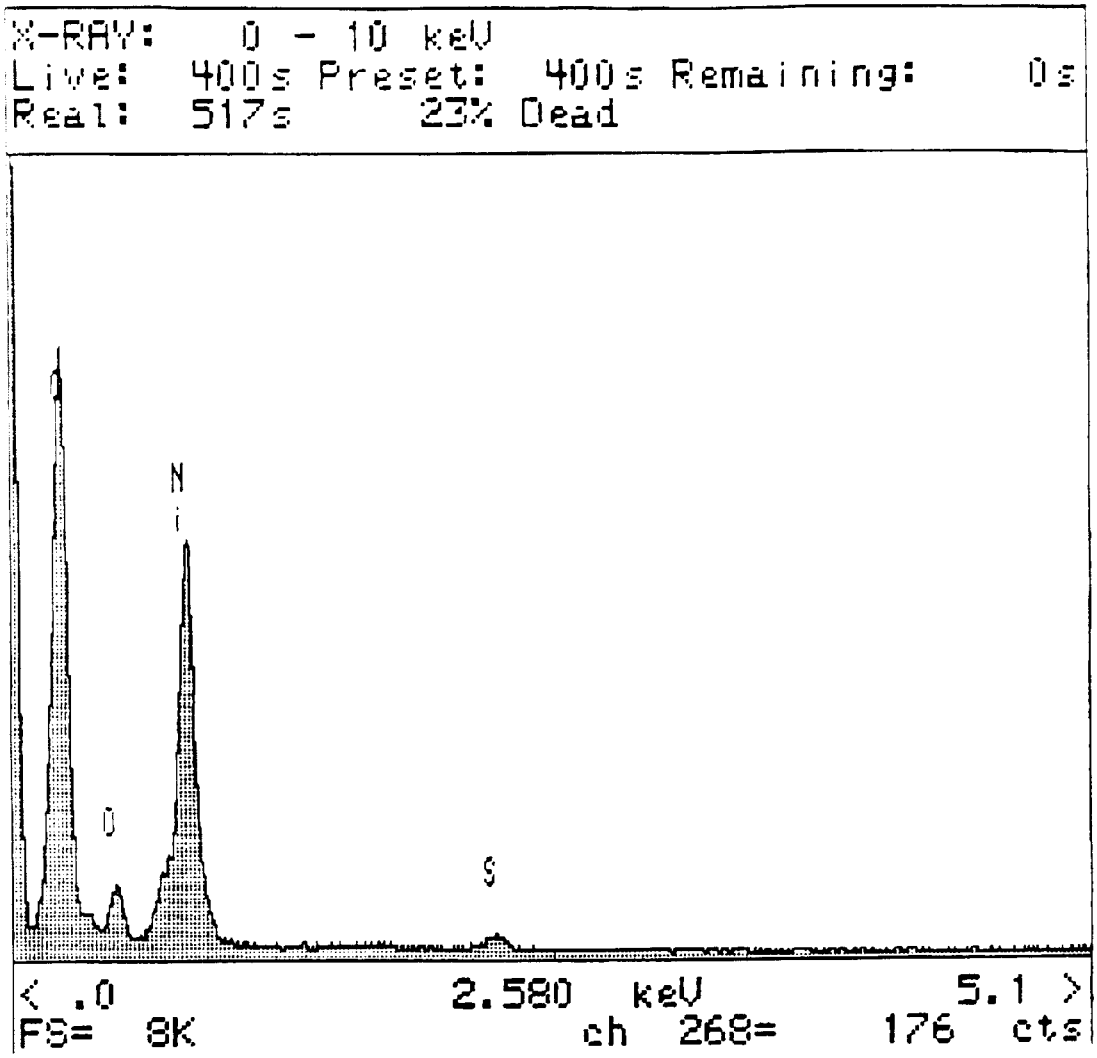
FIG. 6(*a*) is an EDS spectrum of the surface of a nickel disk immersed in gasoline containing 8 vppm $H_2SO_4$ and 200 vppm Tolad 9702 showing S and O peaks indicative of the presence of nickel sulfate corrosion product.
Figure 6:
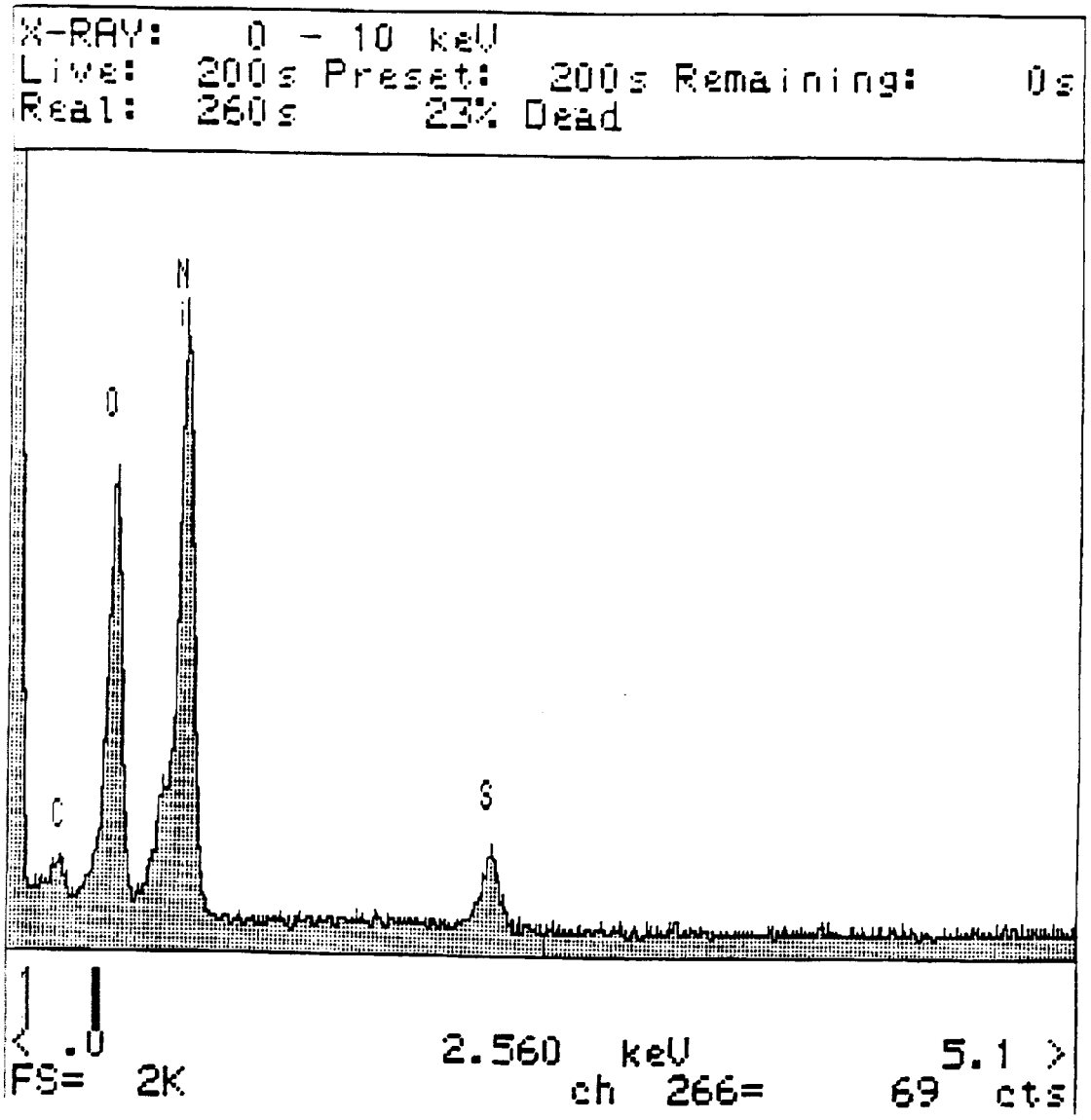

This Example demonstrates that each additive alone, 200 vppm Tolad 9702 (FIG. 6 (*a*)) and 50 vppm Hitec 4313 (FIG. 6 (*b*)) in gasoline containing 8 vppm sulfuric acid is not as effective to inhibit nickel corrosion as the combination of additive shown in Example 2.

EXAMPLE 7

In this Example, a new nickel disk was cleaned at 20° C. in a diluted aqueous sulfuric acid solution before each test. The clean nickel disk was then soaked for 5 minutes into isooctane having dissolved therein various amount of additives. Then, the treated nickel disk was placed in 20 mL of distilled water containing 1 vppm sulfuric acid. The solution was heated to 70° C. for 30 minutes. The nickel disk was examined by X-Ray Photoelectron Spectroscopy (XPS) which provided information from the 5 nm of the surface. The results are presented in Table 1.

| Test No. | Description | Atomic % Ni | S | N |
|---|---|---|---|---|
| 1 | Ni disk cleaned in diluted sulfuric acid solution | 5.6 | 0 | 2.6 |
| 2 | Test 1, then 160 vppm Tolad 9702 + 40 vppm Hitec 4313 | 0.9 | 6.6 | 6.3 |
| 3 | Test 2, then 30 minutes at 70° C. in water containing 1 vppm $H_2SO_4$ | 2.8 | 7.0 | 6.0 |
| 4 | Test 1, then 160 vppm Tolad 9702 | 6.7 | 1.2 | 5.3 |
| 5 | Test 4, then 30 minutes at 70° C. in water containing 1 vppm $H_2SO_4$ | 4.5 | 0 | 4.5 |
| 6 | Test 1, then 40 vppm Hitec 4313 | 3.4 | 4.0 | 3. |
| 7 | Test 6, then 30 minutes at 70° C. in water containing 1 vppm $H_2SO_4$ | 2.7 | 3.9 | 5.6 |
| 8 | Test 1, then 200 vppm additive package (z) of Example 4 | 4.1 | 1.7 | 0.8 |
| 9 | Test 8, then 30 minutes at 70° C. in water containing 1 vppm $H_2SO_4$ | 8.0 | 0 | 1.2 |

The clean-up of the nickel disk with dilute sulfuric acid (Test 1) gave high percent of nickel and relatively low nitrogen, the nitrogen being provided by the water which has been purified over nitrogenous exchange resin. The combination additive Hitec 4313 and Tolad 9702 coats the nickel disk which is demonstrated by the low percent of nickel and high percent of sulfur and nitrogen (Test 2).

The combination of Hitec 4313 and Tolad 9702 gave better coating than each of the additive alone (Test 2 vs. Test 4 and 6). After the acid treatment for 30 minutes (Test 3), the additive still remains on the nickel disk surface. An additive package (z) containing a corrosion inhibitor did not coat the nickel disk surface, which is demonstrated by the high percent of nickel (Tests 8 and 9).

What is claimed is:

1. A distillate fuel composition for internal combustion engines or burners containing nickel parts, having improved nickel corrosion reduction properties which comprises a major amount of a distillate fuel selected from the group consisting of gasoline, diesel fuel and kerosene containing acidic sulfur species contamination and a synergistic additive combination of (a) at least one thiadiazole compound of the formula

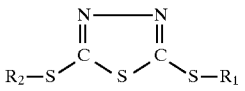

wherein $R_1$ and $R_2$ are hydrogen or $R_3S$ wherein $R_3$ is a $C_1$–$C_{16}$ hydrocarbyl group with the proviso that at least one of $R_1$ and $R_2$ is not hydrogen and wherein said thiadiazole is present in an amount in the range of from about 5 to about 50 vppm for every 1 vppm of acidic sulfur species contamination, in the fuel, and (b) at least one adduct of benzotriazole or tolyltriazole and amine wherein the adduct is present in an amount in the range of from about 50 to 500 vppm for every 1 vppm of acidic sulfur species contamination in the fuel.

2. The distillate fuel composition of claim 1 wherein $R_3$ is a hydrocarbyl group of from 1 to 12 carbon atoms.

3. The distillate fuel composition of claim 1 wherein the adduct is a 1:1 adduct of tolyltriazole with a fatty amine.

4. The distillate fuel composition of claim 1 wherein the amine has the formula $R_4R_5NR_6$ wherein $R_4$ and $R_5$ are $C_1$ to $C_4$ hydrocarbyl groups and $R_6$ is a $C_8$ to $C_{20}$ hydrocarbyl group.

5. The distillate fuel of claim 1 wherein the amine has the formula $R_4R_5NR_6$ wherein $R_4$ and $R_5$ are $C_1$ to $C_4$ hydrocarbyl groups wherein at least one such group is substituted with hydroxy and $R_6$ is a $C_8$ to $C_{20}$ hydrocarbyl group.

6. The distillate fuel of claim 5 wherein $R_4$ and $R_5$ are hydroxyethyl groups.

7. The distillate fuel of claim 5 wherein the adduct is a 1:1 adduct of tolyltriazole with bis (2-hydroxyethyl) oleylamine or with bis (2-hydroxyethyl) cocoamine.

8. A method for reducing nickel corrosion in internal combustion engines or burners operating on distillate fuel selected from the group consisting of gasoline, diesel fuel and kerosene containing acidic sulfur species contamination which comprises running the engine or burner with a fuel composition to which has been added a combination comprising:

(a) at least one thiadiazole compound of the formula

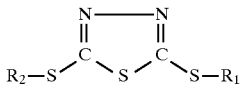

wherein $R_1$ and $R_2$ are hydrogen or $R_3S$ wherein $R_3$ is a $C_1$–$C_{16}$ hydrocarbyl group with the proviso that at least one of $R_1$ and $R_2$ is not hydrogen wherein said thiadizole is present in an amount in the range of from about 5 vppm to about 50 vppm for every 1 vppm of acidic sulfur species contamination, and (b) at least one adduct of benzotriazole or tolyltriazole and amine wherein the adduct is present in an amount in the range of from about 50 to 500 vppm for every 1 vppm of acidic sulfur species contamination in the fuel.

9. The method of claim 8 wherein $R_3$ is a hydrocarbyl group of from 1 to 12 carbon atoms.

10. The method of claim 8 wherein the adduct is a 1:1 adduct of tolyltriazole with a fatty amine.

11. The method of claim 8 wherein the amine has the formula $R_4R_5NR_6$ wherein $R_4$ and $R_5$ are $C_1$ to $C_4$ hydrocarbyl groups and $R_6$ is a $C_8$ to $C_{20}$ hydrocarbyl group.

12. The method of claim 8 wherein the amine has the formula $R_4R_5NR_6$ wherein $R_4$ and $R_5$ are $C_1$ to $C_4$ hydrocarbyl groups wherein at least one such group is substituted with hydroxy and $R_6$ is a $C_8$ to $C_{20}$ hydrocarbyl group.

13. The method of claim 12 wherein $R_4$ and $R_5$ are hydroxyethyl groups.

14. The method of claim 12 wherein the adduct is a 1:1 adduct of tolyltriazole with bis (2-hydroxyethyl) oleylamine or with bis (2-hydroxyethyl) cocoamine.

* * * * *